US006245219B1

(12) United States Patent
Kao

(10) Patent No.: US 6,245,219 B1
(45) **Date of Patent: *Jun. 12, 2001**

(54) NAPHTHA AROMATIZATION PROCESS

(75) Inventor: Jar-Lin Kao, Houston, TX (US)

(73) Assignee: ExxonMobil Chemical Patents Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/844,711

(22) Filed: Apr. 18, 1997

(51) Int. Cl.[7] ..... C10G 35/06
(52) U.S. Cl. ..... 208/137; 208/134; 208/135
(58) Field of Search ..... 208/134, 135, 208/137

(56) References Cited

U.S. PATENT DOCUMENTS

| | | | | |
|---|---|---|---|---|
| 3,756,942 | | 9/1973 | Cattanach | 208/137 |
| 3,855,115 | * | 12/1974 | Morrison | 208/135 |
| 3,894,104 | * | 7/1975 | Chang | 208/135 |
| 4,120,910 | | 10/1978 | Chu | 260/673 |
| 4,175,057 | | 11/1979 | Davies | 252/455 |
| 4,197,214 | * | 4/1980 | Chen | 208/135 |
| 4,350,835 | | 9/1982 | Chester | 585/415 |
| 4,490,569 | | 12/1984 | Chu | 585/415 |
| 4,927,525 | | 5/1990 | Chu | 208/138 |
| 4,933,310 | | 6/1990 | Aufdembrink | 502/71 |
| 4,950,835 | | 8/1990 | Wang | 584/467 |
| 4,975,402 | * | 12/1990 | Le Van Mao et al. | 502/69 |
| 4,987,109 | | 1/1991 | Kao | 502/66 |
| 5,169,813 | * | 12/1992 | Miller et al. | 502/62 |
| 5,202,513 | | 4/1993 | Kanai | 585/407 |
| 5,321,183 | * | 6/1994 | Chang | 585/475 |
| 5,367,099 | * | 11/1994 | Beck | 585/475 |
| 5,371,312 | | 12/1994 | Lago | 585/475 |
| 5,574,199 | * | 11/1996 | Beck et al. | 585/407 |

FOREIGN PATENT DOCUMENTS

| | | |
|---|---|---|
| 0 361 424 A2 | 4/1990 | (EP) . |
| 0 530 069 A1 | 3/1993 | (EP) . |
| WO89/04818 | 6/1989 | (WO) . |
| WO96/03209 | 2/1996 | (WO) . |

* cited by examiner

*Primary Examiner*—Helane E. Myers
(74) *Attorney, Agent, or Firm*—Edward F. Sherer

(57) ABSTRACT

A process for reforming naphtha-containing hydrocarbon feedstreams is disclosed wherein a naphtha stream containing at least about 25 wt % of $C_5$ to $C_9$ aliphatic and cycloaliphatic hydrocarbons is contacted with a modified reforming catalyst, e.g. ZSM-5, containing a dehydrogenation metal, e.g. zinc, which has been modified by contact with Group IIA alkaline earth metal, e.g. barium, or with an organosilicon compound in an amount sufficient to neutralize at least a portion of the surface acidic sites present on the catalyst. The resulting reformate contains a reduced content of $C_1$ to $C_4$ gas and a $C_8$ aromatic fraction having an enhanced content of para-xyelene.

21 Claims, No Drawings

NAPHTHA AROMATIZATION PROCESS

BACKGROUND OF THE INVENTION

1. Field of the Invention

The invention relates to a process for reforming a naphtha stream using a surface treated zeolite catalyst.

2. Description of Related Art

Naphtha streams emerging from petrochemical refining processes generally comprise a mixture of $C_5$ to $C_{13}$ hydrocarbons which include about 15 to 40 wt. % of $C_6$ to $C_{11}$ aromatic compounds and the balance mostly a mixture of $C_5$ to $C_{11}$ aliphatic hydrocarbons, including mixed paraffins and mixed olefins.

It is well known in the art that such streams may be subjected to catalytic reforming to further enhance the more valuable aromatics content of the naphtha. In a typical reforming process, naphtha is passed over an acidic, medium pore zeolite catalyst, such as ZSM-5, which may also contain one or more dehydrogenation metals such as noble metals, under reforming conditions which include a temperature of 400–10000F., pressures of 50–300 psig, weight hourly space velocity of 0.5–25 and in the optional presence of hydrogen ($H_2$ to oil mole ratio of about 0–10). In a typical reforming process, the reactions include dehydrogenation, dehydrocyclization, isomerization and hydrocracking. For example, the use of a zinc-modified ZSM-5 aluminosilicate as a reforming catalyst for light naphtha feedstock is disclosed by Fukase et al, "Catalysts in Petrochemical Refining and Petrochemical Industries 1995", 1996, pp 456–464.

The dehydrogenation reactions typically include dehydroisomerization of alkylcyclopentanes to aromatics, the dehydrogenation of paraffins to olefins, the dehydrogenation of cyclohexanes to aromatics and the dehydrocyclizaiton of acyclic paraffins and acyclic olefins to aromatics. The aromatization of the n-paraffins to aromatics is generally considered to be the most important because of the high octane rating of the resulting aromatic product. The isomerization reactions include isomerization of n-paraffins to isoparaffins, the hydroisomerization of olefins to isopraffins, and the isomerization of substituted aromatics. The hydrocracking reactions include the hydrocracking of paraffins and hydrodesulfurization of sulfur compounds in the feed stock.

Acidic zeolites of the HZSM-5 type are also well known catalysts for use in toluene disproportionation reactions wherein toluene or mixtures of toluene and methanol are fed over the catalyst under disproportionation/alkylation conditions. In many such processes, the catalyst is first treated with a silicon-containing compound or other material to reduce the surface acidity of the catalyst. This technique has been found to enhance selectivity of the disproportionation process towards the production of the more valuable para-xylene isomers, in contrast with the meta or ortho isomers. Examples of such processes are found in U.S. Pat. Nos. 4,950,835, 5,321,183 and 5,367,099.

U.S. Pat. No. 5,371,312 discloses a process for the conversion of hydrocarbons comprising passing a hydrocarbon stream over a zeolite which has been treated with an amino silane. When the conversion process is toluene disproportionation, the patent indicates that the catalyst may also contain a dehydrogenation metal such as platinum to reduce the amount of ethyl benzene by-product formed in the process.

In addition, U.S. Pat. No. 5,202,513 discloses the use of a galloalumino silicate catalyst of the ZSM-5 type containing gallium as part of the crystal structure which is treated with an alkali hydroxide, used as a reforming catalyst for naphtha-type feeds.

In an article by Y. S. Bhat et al., Appl. Catal. A, 130 (1995) L1-L4, it is disclosed that n-pentane aromatization over an MFI catalyst which has been silylated by vapor deposition of an organosilicone compound gives increased selectivity towards para-xylene production.

WO 96/03209 discloses a reforming process wherein a $C_5$–$C_9$ paraffin or olefin feedstock is contacted under reforming conditions with a zeolite catalyst which has been modified with a platinum group component metal and a second metal selected from gallium, zinc, indium, iron, tin and boron. The publication indicates that the process leads to an increased yield of para-xylene and that the yield of para-xylene is further enhanced by pre-coking the catalyst prior to use in the reforming process.

One of the major drawbacks associated with the use of acidic medium pore zeolite catalysts in reforming process, as contrasted with disproportionation processes, is that an undesirable amount of molecular cracking takes place wherein a significant portion of molecules having 5 or more carbon atoms are degraded, rather than upgraded into more valuable products. As a result, quantities of low value $C_1$ to $C_4$ gases are produced, often in quantities of greater than about 25 wt % of the initial naphtha feedstream.

Accordingly, it is an object of this invention to provide a process for reforming a naphtha feed using a modified zeolite catalyst wherein the quantity of low value $C_1$ to $C_4$ gas by-product produced in the process is markedly reduced.

Another object of the invention is to provide a process for reforming a naphtha feed using a modified zeolite catalyst wherein the para-xylene content of the $C_8$ aromatic product present in the reformate is produced in greater than an equilibrium-amount.

SUMMARY OF THE INVENTION

The present invention provides a process for reforming a naphtha hydrocarbon stream containing at least about 25 wt % of $C_5$ to $C_9$ aliphatic and cycloaliphatic hydrocarbons comprising contacting said stream under reforming conditions with a modified reforming catalyst comprising an intermediate pore size acidic aluminosilicate support impregnated with at least one dehydrogenation metal selected from the group consisting of gallium, zinc, indium, iron, tin and boron, and oxides or sulfides thereof, said catalyst modified by (a) contact of said impregnated aluminosilicate support with a Periodic Table Group IIA metal hydroxide or an organosilicon compound in an amount sufficient to neutralize at least a portion of the acid sites present on the surface of said support and (b) calcination of said support, the reformed naphtha product of said process containing less than about 25wt % of $C_1$ –$C_4$ gas.

The process of the invention provides a reformate product which on the one hand, contains a reduced content of low value $C_1$ to $C_4$ gases which are primarily the by-product of cracked $C_{4+}$aliphatic and cycloaliphatic compounds while, on the other hand, maintaining a high yield of more valuable $C_6$ to $C_9$ aromatics in the reformate, and greater than equilibrium-amount yields of para-xylene in the C8 aromatic component of the reformate.

DETAILED DESCRIPTION OF THE INVENTION

Zeolites which may be used as molecular sieve support material for the catalyst of the present invention include intermediate pore size zeolites having an average pore size in the range of about 6 to 7 Angstroms and a $SiO_2/Al_2O_3$ ratio of at least 10. These include zeolites having a MFI, MEL, TON, MTT or FER crystalline structure. Preferred such zeolites include ZSM-5, silicalite (a high silica to alumina ratio form of ZSM-5), ZSM-11, ZSM-12, ZSM-21, ZSM-22, ZSM-23, ZSM-35 and ZSM-38, with ZSM-5 being most preferred. The zeolite is preferably used in its highly acidic form, e.g. HZSM-5. Where the zeolite, as synthesized, contains alkali or alkaline earth metal cations, these can be exchanged with ammonium cations, followed by calicantion in air at 600° F. to 1000° F. by techniques well known in the art to produce the acid form of the zeolite.

The dehydrogenation metals may be incorporated into the zeolite structure by any suitable method such as impregnation (incipient wetness method) or by ion exchange.

In the preferred embodiment, the zeolite is impregnated with the metal by well known methods such as by contacting a solution of a metal salt dissolved in an aqueous or alcoholic medium with the zeolite particles for a period of time sufficient to allow the cations to penetrate the zeolite pore structure. Suitable salts include the chlorides and nitrates. After drying the resulting zeolite precursor, it is preferably calcined at temperatures of 300° C.–600° C. for a period of 1–6 hours. In most cases, the metal will be present in the zeolite structure in the form of the oxide. However, where the feed naphtha contains significant levels of sulfur, hydrogen sulfide may form under reforming conditions which may, in turn, react with the metal oxide to form at least some metal sulfide. Thus, the metal may be in the form of the oxide, the sulfide or mixtures of these during the reforming process. The preferred metal loading may range from about 0.1 to 10 wt %, most preferably from about 0.5 to 5 wt %.

In the preferred embodiment of the invention, the dehydrogenation metal present in the zeolite consists essentially of one or a mixture of gallium, zinc, indium, iron, tin or boron metal compounds, and does not contain a noble metal such as platinum, platinum/rhenium or platinum/iridium which tend to be more sensitive to deactivation by sulfur poisoning and/or coke build-up under reforming conditions. Thus, naphtha feedstreams containing 10 to 500 ppm of sulfur or sulfur-containing compounds need not necessarily be subjected to a dehydrosulfurization treatment prior to contact with the catalyst of this invention.

The aluminosilicate support impregnated with the dehydrogenation metal is then modified by contact of the support with a hydroxide of a Group IIA metal or an organosilicon compound in an amount sufficient to neutralize at least a portion of the acid sites present on the surface of the support, after which the catalyst is dried and calcined in air to provide the modified catalyst of this invention. The term "neutralized" as used herein is intended to mean not only chemical neutralization of the support such as displacement of H+ cations by alkaline earth metal ions, but also blocking of surface H+ cations by silicon compounds deposited on the surface of the support and within the channels of the support.

Where the neutralizing agent is a Group IIA metal hydroxide, the aluminosilicate support may be modified by dispersing the aluminosilicate in an about 0.1 to 2 normal aqueous solution of the hydroxide for a period of from about 0.2 to 1 hour. Preferably the dispersion is heated at 25° C. up to reflux temperature for a period of about ½ to one hour. Thereafter, the modified aluminosilicate is separated from the solution, dried and calcined in air at a temperature of up to 1000° C., preferably from about 300° C. to 600° C. for a period of 1–24 hours.

Organosilicon compounds which may be used to modify the catalyst include compounds selected from the group consisting of silanes, silicones, and alkylsilicates. Suitable silanes include alkoxy silanes such as tetramethoxy or tetraethyoxy silane. Suitable silicones and silicone polymers include compounds having the formula $—[R_1R_2SiO]_n$ wherein $R_1$ and $R_2$ are the same or different $C_1$ to $C_4$ alkyl groups, phenyl groups, halogen, hydrogen, hydroxy, alkoxy, aralkyl and the like with at least one of $R_1$ or $R_2$ being an organic group, and n ranges from 2 to 1,000. Examples of preferred silicones include dimethylsilicone, copolymers of dimethylsiloxane and a lower alkylene oxide such as ethylene oxide, diethylsilicone, methyl hydrogen silicone and the like. Suitable alkyl silicates include $C_1$ to $C_4$ alkyl silicates such as methyl silicate or ethyl silicate.

The silicon compound may be deposited on the surface of the aluminosilicate by any suitable method. For example, the silicon compound may be used in liquid heat form or may be dissolved or dispersed in a solvent or aqueous medium to form a solution, dispersion or emulsion, mixed with the aluminosilicate to form a paste, dried and calcined. This deposition process can be repeated one or more times to provide a more uniformly coated product. Alternatively, the silicon compound may be deposited on the aluminosilicate surface by well known vapor deposition techniques. The deposited silicon compound extensively covers and resides on the external surface of the aluminosilicate molecular sieve and on surfaces within the molecular sieve channels. The silicon treated aluminosilicate is then calcined in air at a temperature of up to 1000° C., preferably from 3000° C. to 6000° C., for a period of 1 to 24 hours.

Neutralization methods as described above should be sufficient to neutralize at least about 50%, more preferably at least about 75%, and most preferably at least about 90% of the acidic sites present on the surface of the catalyst.

The zeolite may be used in the catalytic process in its crystalline particulate form or it may be combined with 50–90 wt % of a binder material such a silica, alumina or various clay materials as is known in the art to form molded pellets or extrudates. A zeolite-bound ZSM-5-free extrudate can also be used in the process. The metal impregnation and/or silicon compound deposition process described above may be carried out before or after the zeolite is composited with the binder, preferably before.

As indicated above, the content of cracked $C_1$–$C_4$ paraffin gases produced in the naphtha reforming process of this invention is significantly lower than that produced in conventional naphtha reforming, generally less than 25wt % and often less than 20 wt % of the reformate product.

Typical naphtha feeds which may be processed in accordance with this invention are refinery products containing at least abut 25 wt %, more usually at least about 35wt %, and most usually about 50 wt % of $C_5$ to C9 aliphatic and cycloaliphatic hydrocarbons such as olefins and paraffins, about 30–40 wt % of $C_6$ to $C_{13}$ aromatics, of which at least 5 wt %, more usually at least 10 wt % constitutes C9+ aromatics and roughly 10–20 wt % of which constitutes $C_6$–$C_8$ aromatics (BTX). These naphtha feeds may also contain 50 to 500 weight ppm sulfur and about 10–100 weight ppm of nitrogen compounds. The term "sulfur" as used herein refers to elemental sulfur as well as sulfur compounds such as organosulfides or heterocyclic benzothiophenes. Typical examples of aliphatic hydrocarbons present in the naphtha stream include paraffins such as n-hexane, 2-methylpentane, 3-methylpentane, n-heptane, 2-methylhexane, 3-methylhexane, 3-ethylpentane, 2,5-dimethylhexane, n-octane, 2-methylheptane, 3-ethylhexane, n-nonane, 2-methyloctane, 3-methylocatane and n-decane, as well as corresponding $C_5$ to $C_9$ cycloparaffins. Typical olefins include 1-hexene, 2-methyl-1-pentene, 1-heptene 1-octene and 1-nonene. Aromatics include benzene, toluene, xylenes as well as $C_9$ to $C_{11}$ aromatics.

The naphtha is upgraded by passing it through one or more catalyst beds positioned in a reforming reactor. Suitable reforming conditions are as follows:

| | General | Preferred |
|---|---|---|
| Temp (° F.) | 400–1000 | 800–1000 |
| Press. (psig) | 10–300 | 50–300 |
| WHSV | 0.5–25 | 0.5–3 |
| $H_2$/oil mole ratio | 0–10 | 1–10 |

The following examples are illustrative of the invention.

EXAMPLE 1

The catalyst modified in accordance with Examples 2 and 3 was prepared by impregnating 40.33 grams of calcined H+ZSM-5 powder with a solution of 2.76 grams of $Zn(NO_3)_2$ and 37.97 grams of water. After drying at 120° C. for 2 hours, the catalyst precursor was calcined at 500° C. for 4 hours to give a ZnO/HZSM-5 catalyst (ZnZSM-5).

EXAMPLE 2

13.76 g of the ZnZSM-5 catalyst prepared in Example 1 was mixed with a solution of 4.77 g of tetraethyl orthosilicate (ethyl silicate) dissolved in 9 g of n-heptane. The wet paste was dried at ambient conditions for 4 hours, pelletized to 16/45 mesh and calcined at 500° C. with 502 ml/min air flow rate for 8 hours to yield a silica coated, modified ZnZSM-5 catalyst [Si]ZnZSM-5.

EXAMPLE 3

A mixture of 20.46 g of the ZnZSM-5 catalyst prepared in Example 1, 0.59 g of barium hydroxide and 200 ml. of water were heated under reflux for 0.5 hour. After centrifuging, the wet solid was dried in a vacuum at 50° C. for 5 hours and at 120° C. for 3 hours. The dried product was pelletized to 16/45 mesh and calcined in air at 500° C. for 2.5 hours to yield a barium neutralized ZnZSM-5 catalyst [Ba]ZnZSM-5.

EXAMPLES 4–6

EVALUATION OF CATALYSTS

The catalytic test was conducted in a fixed bed at reactor 890° F., 100 psig, 2 WHSV, 2 $H_2$/feed and using a $C_5$-430° F. CAT naphtha as the feed. The CAT naphtha feed contained 460 ppm sulfur, 76 ppm nitrogen, 38.1 wt % paraffins, 11.4 wt % cycloparaffins, 16.1 wt % olefins and 34.4 wt % aromatics. The experimental results of these tests are as shown in Table 1.

TABLE 1

| | | FEED | % Yield at 21 hr | | | | | | | | $C_6$– | GAS |
|---|---|---|---|---|---|---|---|---|---|---|---|---|
| EX | CATALYST | CONV. | $A_6$ | $A_7$ | $A_8$ | $A_9$ | $A_{10}$ | $C_2$= | $C_3$= | $C_4$= | $C_9$ | ($C_1$–$C^4$) |
| 4 | ZnZSM-5 | 88.5 | 7.1 | 19.5 | 16.3 | 4.6 | 1.0 | 0.4 | 0.7 | 0.3 | 7.1 | 42.9 |
| 5 | [Si]ZnZSM-5 | 45.3 | 2.2 | 10.7 | 14.9 | 13.6 | 5.3 | 1.5 | 3.8 | 4.7 | 33.4 | 9.9 |
| 6 | [Ba]ZnZSM-5 | 57.8 | 3.2 | 11.8 | 17.6 | 10.9 | 1.7 | 1.5 | 3.9 | 4.0 | 25.8 | 19.6 |

As can be seen in the results of Table 1, coating or neutralizing the ZnZSM-5 reduced the gas make to 9.9 or 19.6 wt %, respectively, down from 42.9 wt % achieved using the non-modified catalyst, while maintaining a 45–47 wt % aromatics yield.

EXAMPLE 7

The ZnZSM-5 catalyst from Example 1 (25.93 g) was mixed with a dimethylsiloxane-ethylene oxide copolymer (30.64 g) in neat, liquid form at room temperature for 1 hr and dried in vacuum at 60° C. for 4 hr and then calcined at 530° C. for 8 hr to give a one time silica coated ZnZSM-5 catalyst [i.e.(Si)ZnZSM-5]. The above procedure was repeated 3 more times to give a 4×(Si)ZnZSM-5 catalyst.

EXAMPLES 8–9

The CAT naphtha used in Examples 4–6 was reformed over the non-silica containing catalyst prepared in Example 1 and the silica-containing catalyst as prepared in Example 7 under the following conditions: 50 psig, 932° F., 2 WHSV and 4 $H_2$/molar feed ratio. Results are shown in Table 2.

TABLE 2

| | | Yield (wt %) at 21 hr | | | | | | | |
|---|---|---|---|---|---|---|---|---|---|
| Example | Catalyst | $A_6$ | $A_7$ | $A_8$ | $A_9$ | $A_{10}$ | Olefins[1] | $C_5$–$C_9$[2] | $C_1$–$C_4$[2] |
| 8- | ZnZSM-5 | 8.7 | 25.0 | 19.9 | 4.7 | 1.1 | 2.7 | 3.1 | 34.8 |
| 9- | 4x(Si)Zn ZSM-5 | 6.4 | 23.4 | 19.7 | 3.7 | 1.8 | 9.8 | 11.7 | 23.5 |

[1]$C_2$–$C_4$ light olefins
[2]Paraffins

The results of Table 2 show a marked decrease in the production of $C_1$ to $C_4$ paraffin gas and increase in the production of more valuable olefins and $C_5$–$C_9$ paraffins associated with the use of the silicon treated catalyst (Ex. 9) vs the non-treated catalyst (Ex. 8).

EXAMPLES 10–11

Examples 8 and 9 were repeated except that the naphtha stream used was a light virgin $C_5$–$C_{12}$ naphtha containing 81 wt % paraffins and 19 wt % of aromatics. Reforming was conducted under the following low pressure conditions: 10 psig, 980° F., 2 WHSV and 4 $N_2$/molar feed ratio.

Results are shown in Table 3.

TABLE 3

| Example | Catalyst | Yield (wt %) at 1 hr | | | | | | | |
|---|---|---|---|---|---|---|---|---|---|
| | | $A_6$ | $A_7$ | $A_8$ | $A_9$ | $A_{10}$ | Olefins[1] | $C_5$–$C_9$[2] | $C_1$–$C_4$[2] |
| 10- | ZnZSM-5 | 16.3 | 29.0 | 16.4 | 1.8 | 0.3 | 0.6 | 7.1 | 28.5 |
| 11- | 4x(Si)ZnZSM-5 | 11.7 | 19.5 | 11.1 | 2.5 | 0.4 | 19.2 | 15.8 | 19.8 |

Once again the data in Table 3 shows that the catalyst of the invention gives rise to marked reduction in the content of $C_1$–$C_4$ paraffin gases and an enhancement of the light olefin and $C_5$–$C_9$ paraffin content of the reformate.

Another advantage associated with the use of the catalysts of this invention as naphtha reforming catalysts is that the catalyst is more highly selective towards the production of the para-xylene component of the mixed $C_8$ aromatics product produced of the four main $C_8$ products, Para-xylene is considerably more valuable as a chemical intermediate than ethyl benzene or the meta and ortho-xylene isomers. Para-xylene occurs in approximately equilibrium amounts, about 20–25 wt %, depending on the temperature, in the $C_8$ aromatics fraction of a typical reformate stream produced using conventional noble metal-containing catalysts or using ZSM-5 catalysts modified with a dehydrogenation metal such as zinc. Reformate produced using the neutralized catalysts of this invention contains a $C_8$ aromatic fraction which can have a content of para-xylene considerably higher than the equilibrium amount, as illustrated in Example 12 below.

EXAMPLE 12

The liquid products from Examples 8–11 were analyzed by GC to determine the distribution of $C_8$- aromatics as shown in below:

| Ex. No. | Temp. (° F.) | % of Isomer in A Product | | | |
|---|---|---|---|---|---|
| | | EB | MX | PX | OX |
| 8 | 932 | 10.3 | 46.2 | 22.7 | 20.8 |
| 9 | 932 | 11.5 | 37.3 | 32.8 | 18.4 |
| Equilibrium | 932 | 10.2 | 46.5 | 20.9 | 22.4 |
| 10 | 980 | 1.0 | 51.1 | 23.4 | 24.5 |
| 11 | 980 | 12.3 | 28.6 | 42.9 | 16.2 |
| Equilibrium | 980 | 10.8 | 46.0 | 20.7 | 22.5 |

The above data clearly demonstrates that the silica coated ZnZSM-5 catalyst produced 157% and 207% of the equilibrium p-xylene in Example 9 and 11 respectively.

What is claimed is:

1. A process for reforming a naphtha hydrocarbon stream containing at least about 25 wt % of $C_5$ to $C_9$ aliphatic and cycloaliphatic hydrocarbons and at least 10 weight ppm sulfur comprising contacting said stream under reforming conditions with a modified reforming catalyst free of noble metal comprising an intermediate pore size acidic aluminosilicate support impregnated with at least one dehydrogenation metal selected from the group consisting of gallium, zinc, indium, iron, tin and boron, and oxides or sulfides thereof, said catalyst modified by (a) contact of said impregnated aluminosilicate support with a Periodic Table Group IIA metal hydroxide or an organosilicon compound in an amount sufficient to neutralize at least a portion of the acid sites present on the surface of said support and (b) calcination of said support, the reformed naphtha product of said process containing less than about 25wt % of $C_1$–$C_4$ gas.

2. The process of claim 1 wherein said aluminosilicate support is a ZSM-5 zeolite.

3. The process of claim 1 wherein said dehydrogenation metal is zinc.

4. The process of claim 1 wherein said catalyst is modified by contact with a Group IIA metal hydroxide.

5. The process of claim 4 wherein said Group IIA metal is selected from the group consisting of barium, calcium and magnesium.

6. The process of claim 1 wherein said aluminosilicate support is combined with a binder material selected from the group consisting of silica, alumina, clay or zeolite to form catalyst pellets.

7. The process of claim 1 wherein said catalyst is modified by contact with an organosilicon compound.

8. The process of claim 7 wherein said organosilicon compound is selected from the group consisting of silanes, silicones, and alkyl silicates.

9. The process of claim 1 wherein at least about 50% of the acid sites present on the surface of said support are neutralized.

10. The process of claim 1 wherein said reforming conditions comprise a temperature of 400–1000° F., a pressure of 10–300 psig, a weight hourly space velocity of 0.5–25 and a hydrogen to hydrocarbon molar ratio of 0–10.

11. The process of claim 1 wherein said naphtha stream contains at least about 35 wt % of said $C_5$ to $C_9$ aliphatic and cycloaliphatic hydrocarbons.

12. The process of claim 1 wherein the reformed naphtha product of said process contains less than about 20 wt % of $C_1$ to $C_4$ gas.

13. The process of claim 1 wherein the reformed naphtha product of said process contains a $C_8$ aromatic product containing at least about 25 wt % more than the equilibrium amount of para-xylene.

14. The process of claim 1 wherein said stream contains 50–500 weight ppm sulfur.

15. The process of claim 1 wherein said stream also contains 10–100 weight ppm nitrogen compounds.

16. The process of claim 1 wherein said aluminosilicate support comprises a zeolite having an average pore size of about 5 to 7 Angstroms and a $SiO_2/Al_2O_3$ ratio of at least 10.

17. A process for reforming a naphtha hydrocarbon stream containing at least about 25 wt % of $C_5$ to $C_9$ aliphatic and cycloaliphatic hydrocarbons comprising contacting said stream under reforming conditions with a modified reforming catalyst free of noble metal comprising an intermediate pore size acidic aluminosilicate support impregnated with at least one dehydrogenation metal selected from the group consisting of gallium, zinc, indium, iron, tin and boron, and oxides or sulfides thereof, said catalyst modified by (a) contact of said impregnated aluminosilicate support with a Periodic Table Group IIA metal hydroxide in an amount sufficient to neutralize at least a portion of the acid sites present on the surface of said support and (b) calcination of said support, the reformed naphtha product of said process containing less than about 25 wt % of $C_1$–$C_4$ gas.

18. The process of claim 17 wherein said dehydrogenation metal is zinc.

19. The process of claim 17 wherein said Group IIA metal is selected from the group consisting of barium, calcium and magnesium.

20. The process of claim 17 wherein said support is a ZSM-5 zeolite.

21. The process of claim 17 wherein the reformed naphtha product of said process contains a $C_8$ aromatic product containing at least about 25 wt % more than the equilibrium amount of para-Xylene.

* * * * *